US005923929A

United States Patent [19]

Ben Avraham et al.

[11] Patent Number: 5,923,929

[45] Date of Patent: Jul. 13, 1999

[54] IMAGING APPARATUS AND METHOD AND LIQUID TONER THEREFOR

[75] Inventors: Peretz Ben Avraham, Rehovot; Becky Bossidon, Rishonle Zion; Yaacov Almog, Rehovot; Benzion Landa, Nes Ziona, all of Israel

[73] Assignee: Indigo N.V., Maastricht, Netherlands

[21] Appl. No.: 08/849,078

[22] PCT Filed: Dec. 29, 1994

[86] PCT No.: PCT/NL94/00327

§ 371 Date: Jun. 26, 1997

§ 102(e) Date: Jun. 26, 1997

[87] PCT Pub. No.: WO96/17277

PCT Pub. Date: Jun. 6, 1996

[30] Foreign Application Priority Data

Dec. 1, 1994 [IL] Israel ..... 111845

[51] Int. Cl.[6] ..... G03G 15/08

[52] U.S. Cl. ..... 399/237; 430/115; 430/117

[58] Field of Search ..... 399/237, 233; 430/112, 113, 115, 117, 119

[56] References Cited

U.S. PATENT DOCUMENTS

| | | |
|---|---|---|
| 3,965,021 | 6/1976 | Clemens et al. . |
| 4,337,303 | 6/1982 | Sahyun et al. . |
| 4,794,651 | 12/1988 | Landa et al. . |
| 4,842,972 | 6/1989 | Tavernier et al. . |
| 4,910,108 | 3/1990 | Tavernier et al. . |
| 4,974,027 | 11/1990 | Landa et al. . |
| 4,984,025 | 1/1991 | Landa et al. . |
| 4,985,732 | 1/1991 | Landa et al. . |
| 4,999,677 | 3/1991 | Landa et al. . |
| 5,028,964 | 7/1991 | Landa et al. . |
| 5,047,808 | 9/1991 | Landa et al. . |
| 5,089,856 | 2/1992 | Landa et al. . |
| 5,117,263 | 5/1992 | Adam et al. . |
| 5,255,058 | 10/1993 | Pinhas et al. . |
| 5,276,492 | 1/1994 | Landa et al. . |
| 5,280,326 | 1/1994 | Pinhas et al. . |
| 5,289,238 | 2/1994 | Lior et al. . |
| 5,308,729 | 5/1994 | Beach et al. . |
| 5,335,054 | 8/1994 | Landa et al. . |
| 5,346,796 | 9/1994 | Almog . |
| 5,508,790 | 4/1996 | Belinkov et al. . |
| 5,679,492 | 10/1997 | Chamberlain ..... 430/115 |

FOREIGN PATENT DOCUMENTS

| | | |
|---|---|---|
| 046026 | 2/1982 | European Pat. Off. . |
| 247248 | 12/1987 | European Pat. Off. . |
| 568369 | 11/1993 | European Pat. Off. . |
| 9014619 | 11/1990 | WIPO . |
| 9402887 | 2/1994 | WIPO . |

OTHER PUBLICATIONS

An International Search Report issued with Application No. PCT/NL94/00327 and Annex.
A Written Opinion.
An International Preliminary Examination Report.
Patent Abstracts of Japan, unexamined applications, P Section, vol. 15, No. 166, Apr. 25, 1991, p. 146, P1195.
Patent Abstracts of Japan, unexamined applications, P section, vol. 17, No. 402, Jul. 27, 1993, p. 86, P1580.
Patent Abstracts of Japan, unexamined applications, P Section, vol. 16, No. 171, Apr. 24, 1992, p. 146, P1344.
Patent Abstracts of Japan, unexamined applications, P Section, vol. 17, No. 323, Jun. 18, p. 15, P1559.

*Primary Examiner*—Arthur T. Grimley
*Assistant Examiner*—Quana Grainger
*Attorney, Agent, or Firm*—Greenblum & Bernstein P.L.C.

[57] ABSTRACT

Scuff resistance, abrasion resistance and peel resistance of a wide class of liquid toners may be improved by the addition of a minor amount of an additional material which, at the fusing temperature used for the toner, has a much lower viscosity, preferably several orders of magnitude lower, than the viscosity of the toner particles at the fusing temperature and which forms a separate phase from the toner particles when solidified. It is believed that such material, during the fusing process, migrates to the outer surface of the image. During cooling of the image after it is fused, the additional material forms a substantially separate phase resulting in a hard slippery coating of the additional material which protects the image from abrasion.

35 Claims, 5 Drawing Sheets

FIG. 4A
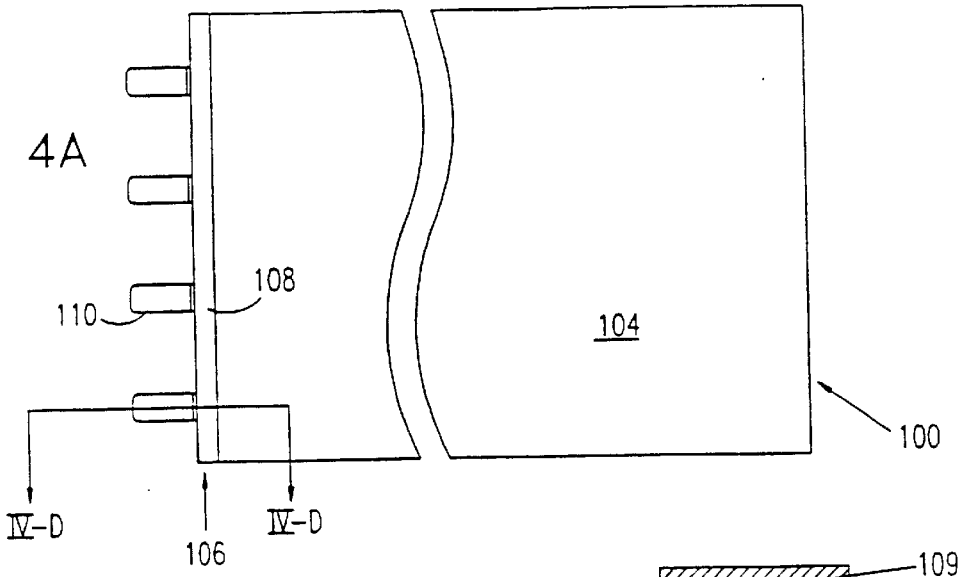
FIG. 4C
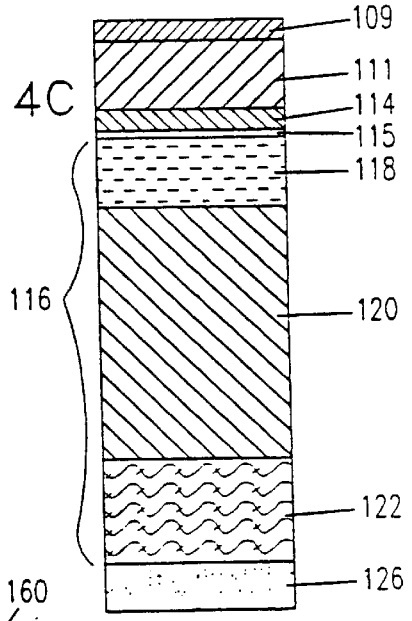
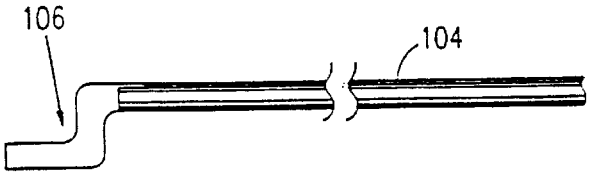
FIG. 4B
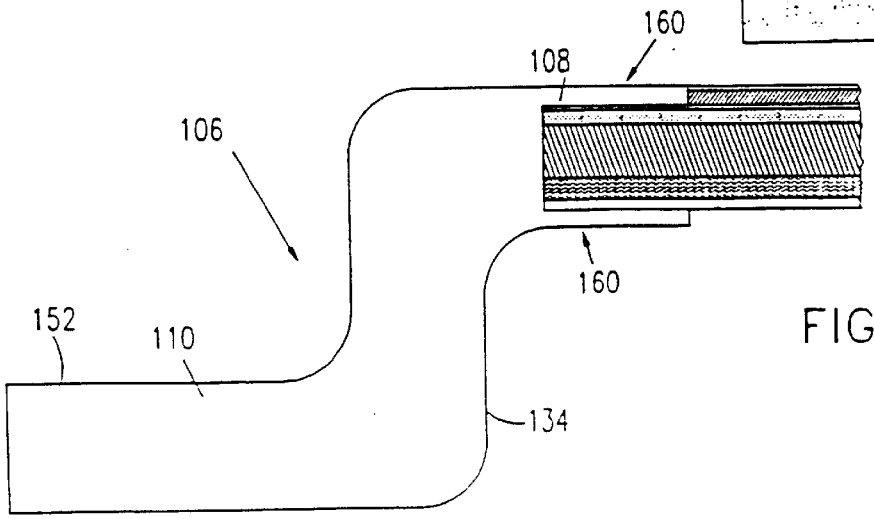
FIG. 4D

IMAGING APPARATUS AND METHOD AND LIQUID TONER THEREFOR

FIELD OF THE INVENTION

The present invention relates to a liquid toner and imaging method and apparatus using the liquid toner.

BACKGROUND OF THE INVENTION

Liquid toners have been in use for a great many years. In U.S. Pat. No. 4,794,651, and in a number of other patents and publications based on this patent, liquid toner having fibrous or tentacular toner particles made of various material was described.

There has been a need to provide a liquid toner, which when used to form an image on a substrate, forms a more abrasion resistant image than those formed by prior art liquid toners.

It is known in the printing art to add particles, for example polyethylene particles, to ink or to the surface of the substrate in order to improve the abrasion resistance of the ink. Such particles project from the surface of the printed image and the image is more resistant to abrasion from paper. However, abrasion resistance to a conforming eraser is increase by a much smaller amount, if at all.

It is also known in the art to coat an already printed image with an abrasion resistant coating.

SUMMARY OF THE INVENTION

The present invention seeks to provide, in one aspect thereof, an improved toner having greater abrasion resistance than prior art toners.

The present invention seeks to provide in a related aspect a method for producing images using the new liquid toner.

It has been found that the scuff resistance, abrasion resistance and peel resistance of a wide class of liquid toners may be improved by the addition of a minor amount of an additional material which, at the fusing temperature used for the toner, has a much lower viscosity, preferably several orders of magnitude lower, than the viscosity of the toner particles at the fusing temperature and which forms a separate phase from the toner particles when solidified.

It is believed that such material, during the fusing process, migrates to the outer surface of the image. During cooling of the image after it is fused, the additional material forms a substantially separate phase resulting in a hard slippery coating of the additional material which protects the image from abrasion.

It has been found that the additional material may be added at almost any point during the toner manufacturing process, but that the effect of the material is most pronounced when the material is added during the final stage of the grinding of tire toner or when it is separately ground and added as finely ground material to the toner.

There is thus provided, in accordance with a preferred embodiment of the invention an image forming method comprising:

providing an image on a substrate, the image comprising toner particles including a polymer material, preferably comprising one or more of an ethylene copolymer, an ethylene terpolymer or an ionomer; an additional material, preferably comprising one or more of polyethylene, a polyethylene wax, a homopolymer and a low molecular weight ionomer, which additional material is solid at room temperature; and carrier liquid;

fusing the image to the substrate by heating the image to a fusing temperature at which the toner particles soften to a first viscosity, wherein the additional material has a second viscosity at the fusing temperature which is at least ten times lower and preferably at least two or three orders of magnitude lower than the first viscosity.

Preferably the toner particles are solvated by the carrier liquid at the fusing temperature whereby their viscosity is reduced to the first viscosity. Preferably the additional material is solvated by the carrier liquid at the fusing temperature whereby its viscosity is reduced to the second viscosity.

Preferably, during fusing or subsequent cooling, the additional material migrates to the surface of the image away from the substrate. In a preferred embodiment of the invention, during cooling, at least a portion of the additional material forms a separate phase from the toner material at said surface, whereby the additional material forms a abrasion resistant layer covering the toner material.

In a preferred embodiment of the invention, the additional material is comprised in the toner particles. Alternatively or additionally the additional material is in a finely divided form and is dispersed in the carrier liquid separate from the toner particles.

In a preferred embodiment of the invention, the additional material is at least partially incompatible with the toner particles.

There is further provided in accordance with a preferred embodiment of the invention, a liquid toner adapted for fusing at a fusing temperature comprising:

toner particles comprising a polymer material, preferably incorporating one or more of an ethylene copolymer, an ethylene terpolymer or an ionomer, which has a first viscosity at the fusing temperature;

an additional material, preferably comprising one or more of polyethylene, a polyethylene wax, a homopolymer and a low molecular weight ionomer, which additional material is solid at room temperature and has a second viscosity at the fusing temperature; and carrier liquid, the first viscosity being at least ten times, preferably more than 100 or 1000 times, the second viscosity.

In a preferred embodiment of the toner, the polymer material is solvated by the carrier liquid at the fusing temperature whereby its viscosity is reduced to the first viscosity. Preferably, the additional material is solvated by the carrier liquid at the fusing temperature whereby its viscosity is reduced to the second viscosity.

In a preferred embodiment of the liquid toner, the additional material is comprised in the toner particles. Alternatively or additionally, the additional material is in a finely divided form and is dispersed in the carrier liquid separate from the toner particles.

Preferably, the additional material is at least partially incompatible with the toner particles.

BRIEF DESCRIPTION OF THE DRAWINGS

The present invention will be understood and appreciated more fully from the following detailed description, taken in conjunction with the drawings in which:

FIGS. 4A and 4B are respective top and side views of an intermediate transfer blanket in accordance with a preferred embodiment of the invention;

FIG. 4C shows details of the layered construction of the intermediate transfer blanket in accordance with a preferred embodiment of the invention;

FIG. 4D is a cut-away expanded view of a securing mechanism on the intermediate transfer blanket of FIGS. 4A and 4B.

DETAILED DESCRIPTION OF PREFERRED EMBODIMENTS

Figure 1:
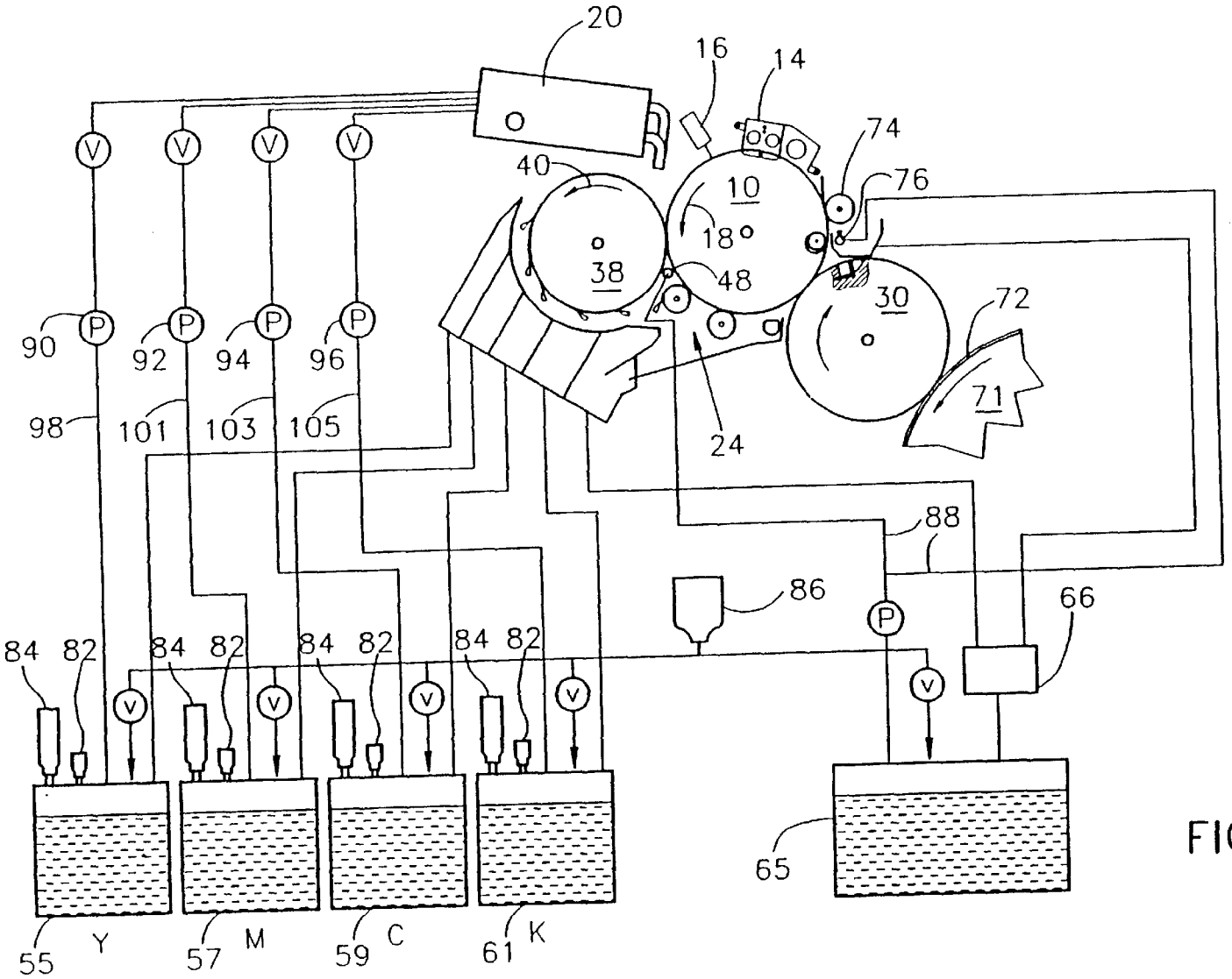
FIG. 1 is a simplified sectional illustration of electrostatic imaging apparatus constructed and operative in accordance with a preferred embodiment of the present invention.
Figure 2:
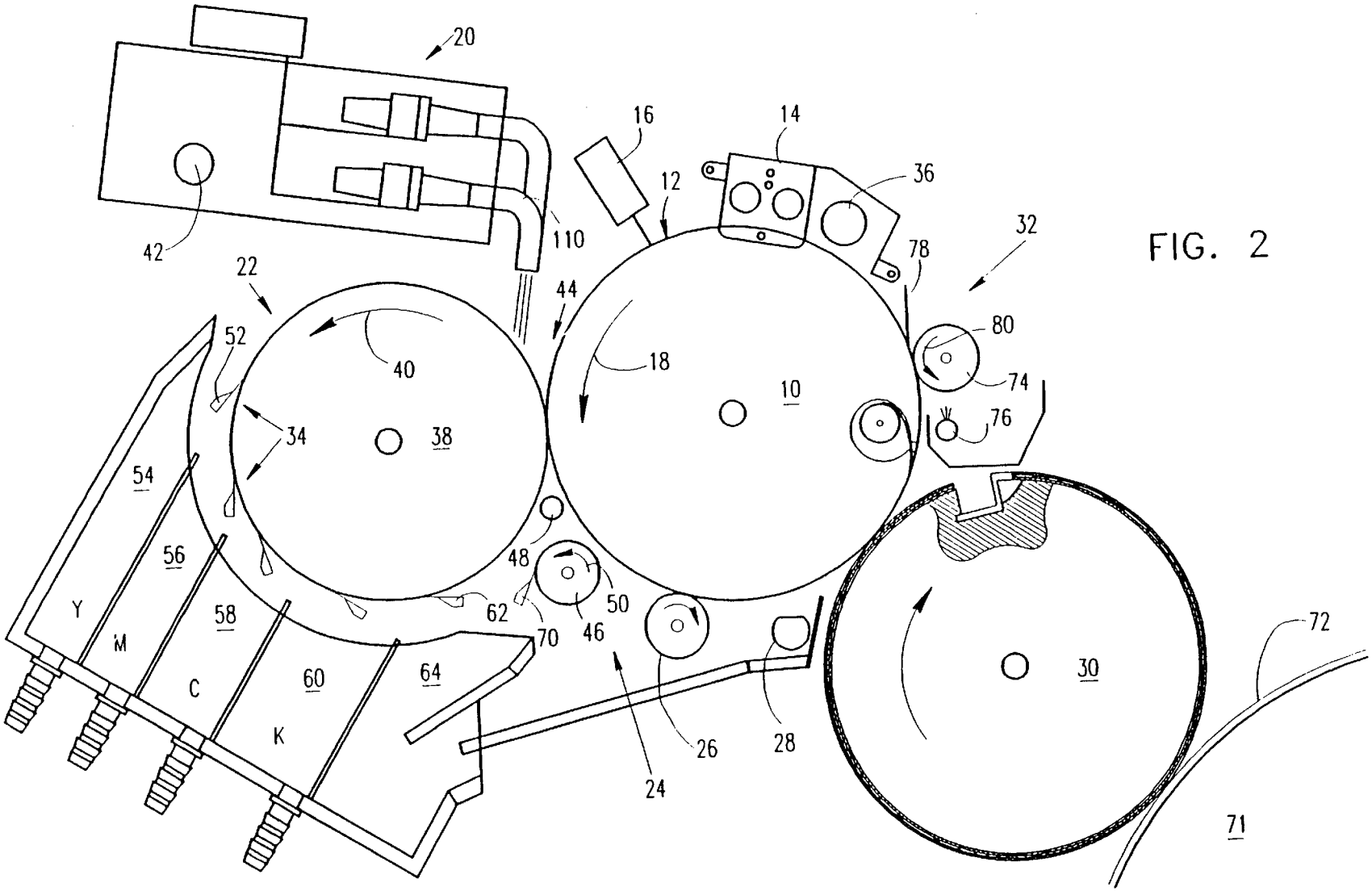
FIG. 2 is a simplified enlarged sectional illustration of the apparatus of FIG. 1.

Reference is now made to FIGS. 1 and 2 which illustrate a multicolor electrostatic imaging system constructed and operative in accordance with a preferred embodiment of the present invention. As seen in FIGS. 1 and 2 there is provided an imaging sheet, preferably an organic photoreceptor 12, typically mounted on a rotating drum 10. Drum 10 is rotated about its axis by a motor or the like (not shown), in the direction of arrow 18, past charging apparatus 14, preferably a corotron, scorotron or roller charger or other suitable charging apparatus known in the art and which is adapted to charge the surface of sheet photoreceptor 12. The image to be reproduced is focused by an imager 16 upon the charged surface 12 at least partially discharging the photoconductor in the areas struck by light, thereby forming the electrostatic latent image. Thus, the latent image normally includes image areas at a first electrical potential and background areas at another electrical potential.

Photoreceptor sheet 12 may use any suitable arrangement of layers of materials as is known in the art, however, in the preferred embodiment of the photoreceptor sheet, certain of the layers are removed from the ends of the sheet to facilitate its mounting on drum 10.

This preferred photoreceptor sheet and preferred methods of mounting it on drum 10 are described in a copending U.S. patent application of Belinkov et al., IMAGING APPARATUS AND PHOTORECEPTOR THEREFOR, filed Sep. 7, 1994, assigned Ser. No. 08/301,775, the disclosure of which is incorporated herein by reference. Alternatively, photoreceptor 12 may be deposited on the drum 10 and may form a continuous surface. Furthermore, photoreceptor 12 may be a non-organic type photoconductor based, for example, on a compound of Selenium.

Imaging apparatus 16 may be a modulated laser beam scanning apparatus, an optical focusing device for imaging a copy on a drum or other imaging apparatus such as is known in the art.

Also associated with drum 10 and photoreceptor sheet 12, in the preferred embodiment of the invention, are a multicolor liquid developer spray assembly 20, a developing assembly 22, color specific cleaning blade assemblies 34, a background cleaning station 24, an electrified squeegee 26, a background discharge device 28, an intermediate transfer member 30, cleaning apparatus 32, and, optionally, a neutralizing lamp assembly 36.

Developing assembly 22 preferably includes a development roller 38. Development roller 38 is preferably spaced from photoreceptor 12 thereby forming a gap therebetween of typically 40 to 150 micrometers and is charged to an electrical potential intermediate that of the image and background areas of the image. Development roller 38 is thus operative, when maintained at a suitable voltage, to apply an electric field to aid development of the latent electrostatic image.

Development roller 38 typically rotates in the same sense as drum 10 as indicated by arrow 40. This rotation provides for the surface of sheet 12 and development roller 38 to have opposite velocities at the gap between them.

Multicolor liquid developer spray assembly 20, whose operation and structure is described in detail in U.S. Pat. No. 5,117,263, the disclosure of which is incorporated herein by reference, may be mounted on axis 42 to allow assembly 20 to be pivoted in such a manner that a spray of liquid toner containing electrically charged pigmented toner particles can be directed either onto a portion of the development roller 38, a portion of the photoreceptor 12 or directly into a development region 44 between photoreceptor 12 and development roller 38. Alternatively, assembly 20 may be fixed. Preferably, the spray is directed onto a portion of the development roller 38.

Color specific cleaning blade assemblies 34 are operatively associated with developer roller 38 for separate removal of residual amounts of each colored toner remaining thereon after development. Each of blade assemblies 34 is selectably brought into operative association with developer roller 38 only when toner of a color corresponding thereto is supplied to development region 44 by spray assembly 20. The construction and operation of cleaning blade assemblies is described in PCT Publication WO 90/14619 and in U.S. Pat. No. 5,289,238, the disclosures of which are incorporated herein by reference.

Each cleaning blade assembly 34 includes a toner directing member 52 which serves to direct the toner removed by the cleaning blade assemblies 34 from the developer roller 38 to separate collection containers 54, 56, 58, and 60, for each color to prevent contamination of the various developers by mixing of the colors. The toner collected by the collection containers is recycled to a corresponding toner reservoir (55, 57, 59 and 61). A final toner directing member 62 always engages the developer roller 38 and the toner collected thereat is supplied into collection container 64 and thereafter to reservoir 65 via separator 66 which is operative to separate relatively clean carrier liquid from the various colored toner particles. The separator 66 may be typically of the type described in U.S. Pat. No. 4,985,732, the disclosure of which is incorporated herein by reference.

In a preferred embodiment of the invention, as described in U.S. Pat. No. 5,255,058, the disclosure of which is incorporated herein by reference, where the imaging speed is very high, a background cleaning station 24 typically including a reverse roller 46 and a fluid spray apparatus 48 is provided. Reverse roller 46 which rotates in a direction indicated by arrow 50 is electrically biased to a potential intermediate that of the image and background areas of photoconductive drum 10, but different from that of the development roller. Reverse roller 46 is preferably spaced apart from photoreceptor sheet 12 thereby forming a gap therebetween which is typically 40 to 150 micrometers.

Fluid spray apparatus 48 receives liquid toner from reservoir 65 via conduit 88 and operates to provide a supply of preferably non-pigmented carrier liquid to the gap between sheet 12 and reverse roller 46. The liquid supplied by fluid spray apparatus 48 replaces the liquid removed from drum 10 by development assembly 22 thus allowing the reverse roller 46 to remove charged pigmented toner particles by electrophoresis from the background areas of the latent image. Excess fluid is removed from reverse roller 46 by a liquid directing member 70 which continuously engages reverse roller 46 to collect excess liquid containing toner particles of various colors which is in turn supplied to reservoir 65 via a collection container 64 and separator 66.

The apparatus embodied in reference numerals 46, 48, 50 and 70 is not required for low speed systems, but is preferably included in high speed systems.

Preferably, an electrically biased squeegee roller 26 is urged against the surface of sheet 12 and is operative to remove liquid carrier from the background regions and to compact the image and remove liquid carrier therefrom in the image regions. Squeegee roller 26 is preferably formed of resilient slightly conductive polymeric material as is well known in the art, and is preferably charged to a potential of several hundred to a few thousand volts with the same polarity as the polarity of the charge on the toner particles.

Discharge device 28 is operative to flood the sheet 12 with light which discharges the voltage remaining on sheet 12, mainly to reduce electrical breakdown and improve transfer of the image to intermediate transfer member 30. Operation of such a device in a write black system is described in U.S. Pat. No. 5,280,326, the disclosure of which is incorporated herein by reference.

FIGS. 1 and 2 further show that multicolor toner spray assembly 20 receives separate supplies of colored toner typically from four different reservoirs 55, 57, 59 and 61. FIG. 1 shows four different colored toner reservoirs 55, 57, 59 and 61 typically containing the colors Yellow, Magenta, Cyan and, optionally, Black respectively. Pumps 90, 92, 94 and 96 may be provided along respective supply conduits 98, 101, 103 and 105 for providing a desired amount of pressure to feed the colored toner to multicolor spray assembly 20. Alternatively, multicolor toner spray assembly 20, which is preferably a three level spray assembly, receives supplies of colored toner from up to six different reservoirs (not shown) which allows for custom colored tones in addition to the standard process colors.

It has been found that the scuff resistance, abrasion resistance and peel resistance of a wide class of liquid toners may be improved by the addition of a minor amount, between 2% and 20%, preferably between 4% to 15%, most preferably about 10% (with respect to the solids content of the toner) of an additional material which, at the fusing temperature used for the toner, has a much lower viscosity, preferably several orders of magnitude lower, than the viscosity of the toner particles and which forms a separate phase from the toner particles when solidified. It is believed that such material, during the fusing process, migrates to the outer surface of the image. During cooling of the image after it is fused, the additional material forms a substantially separate phase resulting in a hard slippery outer coating of the additional material which protects the image from abrasion. While not believed to be absolutely necessary for the invention, the additional materials which have been found useful are at least partially incompatible with the toner particles.

It has been found that the additional material may be added at almost any point during the toner manufacturing process, but that the salutary effect of the additional material is most pronounced when it is added during the final stage of the grinding of the toner or when it is separately ground and added as finely ground material to the finished toner and dispersed in the carrier liquid. Somewhat less than optimum results are achieved when the additional material is added at the beginning of the grinding process or during the plasticization of the toner.

The preferred additional material is Micronised Polyethylene Wax, for example ACumist A-12, ACumist B-12 and ACumist C-9 (Allied Signal, Inc.). Other useful materials are A-C 9A and A-C 1702 Homopolymers (Allied Signal), and AC-290, AC-293A and similar ionomers which are low molecular weight ethylene-based copolymers neutralized with metal salts forming ionic clusters, manufactured by Allied Signal and sold under the trade mark "AClyn."

One preferred method of forming a toner having improved abrasion resistance is the following:

1) Solubilizing 1400 grams of Nucrel 925 (ethylene copolymer by Dupont) and 1400 g of Isopar L (Exxon) are thoroughly mixed in an oil heated Ross Double Planetary Mixer at least 24 RPM for 1.5 hours, with the oil temperature at 130° C. 1200 g of preheated Isopar L is added and mixing is continued for an additional hour. The mixture is cooled to 45° C., while stirring is continued over a period of several hours, to form a viscous material.

2) Milling and Grinding 762 grams of the result of the Solubilizing step are ground in a 1S attritor (Union Process Inc. Akron Ohio), charged with 3/16" carbon steel balls at 250 RPM, together with 66.7 grams of Mogul L carbon black (Cabot), 6.7 grams of BT 583D (blue pigment produced by Cookson), 5 grams of aluminum tri stearate and an additional 1459.6 grams of Isopar L for eight hours at 30° C.

3) Continuation of Grinding 34.5 grams of ACumist A-12 is added and grinding is continued for an additional 4 hours. While 4 hours is believed to be the optimal grinding time for the added material, much shorter grinding periods and adding the ACumist A-12 at the start of step 2 (or even at the start of step 1) also give substantially improved abrasion resistance. The resulting particles are fibrous particles having a measured diameter in the range of 1–3 micrometers.

The resulting material is diluted with additional Isopar L and Marcol 82 to give a working developer in which the dry solids portion is about 1.7% and in which the overall ratio of Isopar L to Marcol is between about 50:1 and 500:1, more preferably between about 100:1 and 200:1. Charge director as described in U.S. patent application Ser. No. 07/915,291 (utilizing lecithin, BBP and ICIG3300B) and in WO 94/02887, in an amount equal to 40 mg/gm of solids, is added to charge the toner particles. Other charge directors and additional additives as are known in the art may also be used.

Alternatively, ACumist A-12 or one of the other materials listed can be pre-ground to a particle size of 1 to 2 microns and added to toner produced according to the above method, to which the ACumist A-12 was not added during grinding.

Another additional material which has been found useful is the precipitate formed when the B-12 or the A-12 material (60 grams) is heated and solubilized together with 30 grams of zinc stearate in 556 grams Isopar L and then stirred while cooling to room temperature. This material may be added during the grinding step or separately.

The above described process produces a black toner. Cyan, magenta and yellow toners can be produced by using a different mix of materials for step 2). For Cyan toner 822 g of the solubilized material, 21.33 grams each of BT 583D and BT 788D pigments (Cookson), 1.73 grams of D1355DD pigment (BASF), 7.59 grams of aluminum tri stearate and 1426 grams of Isopar L are used in step 2. For Magenta toner, 810 grams of solubilized material, 48.3 grams of Finess Red F2B, 6.81 grams of aluminum tri-stearate and 1434.2 grams of Isopar L are used in step 2. For yellow toner, 810 grams of solubilized material, 49.1 grams of D1355DD pigment, 6.9 grams of aluminum tri-stearate and 1423 grams of Isopar L are used in step 2.

The additional materials described above also give improved abrasion resistance for liquid toner based on Bynell 2002 (ethylene terpolymer by Dupont), Surlyn 8940 or 8920 (ionomers by Dupont) and Iotek 8030 (ionomer by Iotek) and blends of these materials. The use of additional materials having the characteristics described above is believed to have applicability to a wide range of toners which comprise polymer particles and hydrocarbon carrier liquids.

Intermediate transfer member 30, an especially preferred embodiment of which is described in detail below (in conjunction with FIGS. 3 and 4), may be any suitable intermediate transfer member having a multilayered transfer portion such as those described below or in U.S. Pat. Nos. 5,089,856 or 5,047,808 the disclosures of which are incorporated herein by reference. Member 30 is maintained at a suitable voltage and temperature for electrostatic transfer of the image thereto from the image bearing surface. Intermediate transfer member 30 is preferably associated with a pressure roller 71 for transfer and fusing of the image onto a final substrate 72, such as paper, preferably by heat and pressure. For the especially preferred toner described above, an image temperature of about 95° C. at the inception of fusing is preferred.

Cleaning apparatus 32 is operative to scrub clean the surface of photoreceptor 12 and preferably includes a cleaning roller 74, a sprayer 76 to spray a non-polar cleaning liquid to assist in the scrubbing process and a wiper blade 78 to complete the cleaning of the photoconductive surface. Cleaning roller 74 which may be formed of any synthetic resin known in the art for this purpose is driven in the same sense as drum 10 as indicated by arrow 80, such that the surface of the roller scrubs the surface of the photoreceptor. Any residual charge left on the surface of photoreceptor sheet 12 may be removed by flooding the photoconductive surface with light from optional neutralizing lamp assembly 36, which may not be required in practice.

In accordance with a preferred embodiment of the invention, after developing each image in a given color, the single color image is transferred to intermediate transfer member 30. Subsequent images in different colors are sequentially transferred in alignment with the previous image onto intermediate transfer member 30. When all of the desired images have been transferred thereto, the complete multi-color image is transferred from transfer member 30 to substrate 72. Impression roller 71 only produces operative engagement between intermediate transfer member 30 and substrate 72 when transfer of the composite image to substrate 72 takes place. Alternatively, each single color image is separately transferred to the substrate via the intermediate transfer member. In this case, the substrate is fed through the machine once for each color or is held on a platen and contacted with intermediate transfer member 30 for composite image transfer. Alternatively, the intermediate transfer member is omitted and the developed single color images are transferred sequentially directly from drum 10 to substrate 72.

Figure 3A:
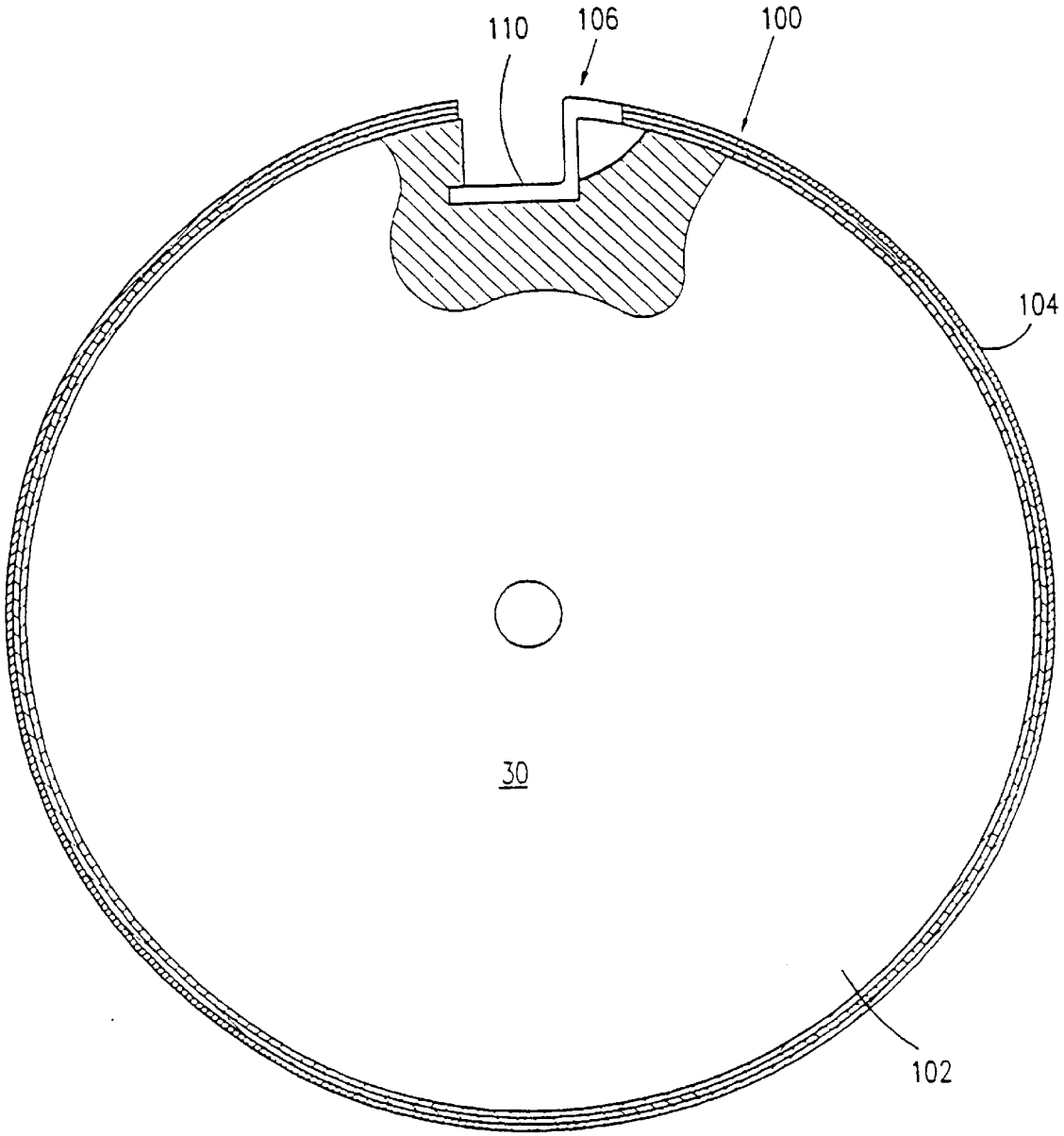
FIG. 3A is a simplified, cross-sectional side view of an intermediate transfer member, including a removable intermediate transfer blanket mounted or a drum, in accordance with a preferred embodiment of the invention.
Figure 3B:
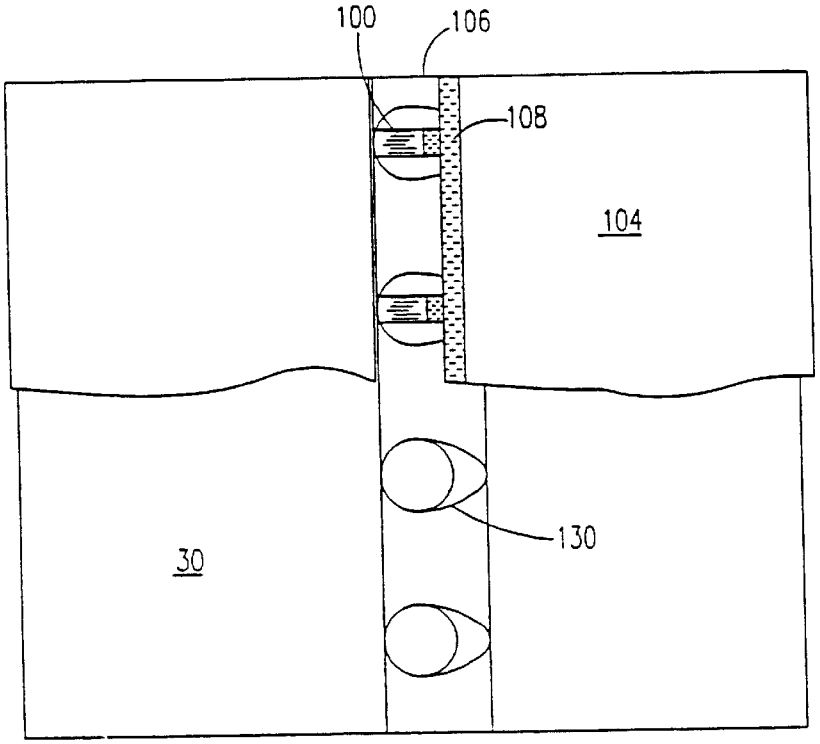
FIG. 3B is a partially cut-away top view of the intermediate transfer member of FIG. 3A.

FIGS. 3A, 3B and 4A–4D illustrate a preferred embodiment of intermediate transfer member 30 in accordance with a preferred embodiment of the invention. FIG. 3A shows an intermediate transfer blanket 100 mounted on a drum 102. Transfer blanket 100 (whose details are shown in FIGS. 4C and 4D) comprises a preferably layered transfer portion 104 and a mounting fitting 106.

As shown most clearly in FIG. 4C, transfer portion 104 comprises a release layer 109 which is outermost on the blanket when it is mounted on drum 102. Underlying layer 109 is a conforming layer 111 preferably of a soft elastomer, preferably of polyurethane and preferably having a Shore A hardness of less than about 65, more preferably, less than about 55, but preferably more than about 35. A suitable hardness value is between 45–55, preferably about 50. Underlying layer 111 is a conductive layer 114 which overlays a thin barrier layer 115. Barrier layer 115 overlays a blanket body 116 comprising a top layer 118, a compressible layer 120 and a fabric layer 122. Underlying the fabric layer is an adhesive layer 126 which is in contact with drum 102.

Drum 102 is preferably heated by an internal halogen lamp heater or other heater to aid transfer of the image to and from the release layer 109 to a final substrate as is well known in the art. For the preferred liquid toner, the temperature at the surface of the intermediate transfer member is preferably about 95° C. The degree of heating will depend on the characteristics of the toner used in conjunction with the invention.

As shown in FIGS. 4A, 4B and 4D, mounting fitting 106 comprises an elongate electrically conducting bar 108, for example, of a metal such as aluminum formed with a series of L-shaped mounting legs 110 (in the form of finger-like extensions) which are also conducting, preferably of the same material as bar 108, and preferably formed integrally therewith. In particular, bar 108 is formed with a slot into which the end of layered transfer portion 104 is inserted. Preferably, the end of the layered portion which is inserted into the mounting bar does not have a release layer 109 or conforming layer 111, whereby conducting layer 114 is exposed and is therefore in electrical contact with bar 108. Alternatively, the bar 108 can be formed with sharp internal projections which pierce the outer layers of the blanket and contact the conducting layer.

Optionally, each of the layers beneath the conducting layer 114 may be partially conducting (for example, by the addition of conductive carbon black or metal fibers) and the adhesive layer may be conductive, such that current also flows directly from the drum surface to the conducting layer.

In one preferred embodiment of the invention, fitting 106 is formed of a single sheet of metal, wherein the legs are partially cut from the metal which is bent into a U shape to form the slot into which the layered portion is inserted. After insertion, the outer walls of the slot are forced against the layered portion to secure the layered portion in the slot. The partially cut out portion is bent to form the mounting legs.

In the preferred embodiment of the invention shown in FIGS. 1–3, drum 102 is maintained at a potential suitable for transferring images to the intermediate transfer member, for example at 500 volts, which voltage is applied, via mounting fitting 106 to conductive layer 114. Thus, the source of transfer voltage is very near the outer surface of portion 104 which allows for a lower transfer potential on the drum.

In a preferred embodiment of the invention, transfer portion 104 is fabricated by the following procedure:

1—The starting structure for blanket construction is a blanket body 116 generally similar to that generally used for printing blankets. One suitable body is MCC-1129-02 manufactured and sold by Reeves SpA, Lodovicio (Milano), Italy. In a preferred embodiment of the invention, body 116 comprises a fabric layer 122, preferably of woven NOMEX material and having a thickness of about 200 micrometers, a compressible layer 120, preferably comprising about 400 micrometers of saturated nitrile rubber loaded with carbon black to increase its thermal conductivity. Layer 120 preferably contains small voids (about 40–60% by volume) and a top layer 118 preferably comprised of the same material as the compressible layer, but without voids. Layer 109 is preferably about 100 micrometers thick. The blanket body is produced by manufacturing methods as are generally used for the production of offset printing blankets for ink offset printing.

Blanket body 116 is preferably sized to a relatively exact thickness by abrading portions of the surface of top layer 118. A preferred thickness for the finished body 116 is about 700 micrometers, although other thicknesses are useful, depending on the geometry of the printing system in which it is used and the exact materials used in the blanket body.

2—The fabric side of blanket body 116 is preferably coated with a 30 micrometer thick coating of silicone based adhesive (preferably, Type D 66 manufactured by Dow Corning). The adhesive is covered with a sheet of mylar coated with a fluorosilicone material, such as DP 5648 Release Paper (one side coat) distributed by H. P. Smith Inc., Bedford Park, Ill. This adhesive is characterized by its good bond to the surface of drum 102 and is resistant to the carrier liquid used in the liquid toner. The blanket may be removed from the drum, when its replacement is desired, by cutting the blanket along the edge of fitting 106 and removing the blanket and fitting.

An adhesive is used to assure good thermal contact between the back of the blanket and the drum on which it is mounted. A silicone adhesive is used since adhesives normally used in attachment of blankets deteriorate under the heat which is generated in the underlying drum in the preferred apparatus. While the temperature of the drum varies, depending on the thermal resistance of the blanket and the desired surface temperature of the blanket (which in turn depends on the toner used in the process and the details of transfer of the toner to the final substrate), the drum temperature may reach 80° C., 100° C., 120° C. or 150° C. or more.

3—Top layer 118 is preferably coated with a sub-micron layer of primer before being coated with additional layers.

A preferred primer is Dow Corning 1205 Prime Coat. The type of primer depends on the properties of the top layer and of the conductive layer. Preferably, 0.3 micron of primer is coated onto a clean top layer with a No. 0 bar in a wire coating apparatus and is allowed to dry before applying the conductive layer.

4—Since blanket body 116 may contain materials such as anti-oxidants, anti-ozonants or other additives which may migrate through the upper layers of the blanket, for example as a gas, when the blanket is heated during the imaging process and/or in the presence of carrier liquid such as Isopar L, barrier layer 115 is preferably coated onto top layer 116. This barrier layer should be substantially impervious to such materials in the blanket body which may migrate and/or to the carrier liquid which is used.

If this layer is omitted, under certain circumstances the additive materials can cause deterioration of the photoreceptor. In particular, it was found that the imaging process may become humidity dependent.

In a preferred embodiment of the invention, a 4–11 micrometer layer of polyvinyl alcohol (88% hydrolyzed) is coated onto the primer layer covering top layer 118.

Polyvinyl alcohol, 88% hydrolyzed, having an average molecular weight preferably between 85,000 and 145,000 (Aldrich Chemical Co. Inc., Milwaukee, Wis.) is dissolved in water at 90° C. by continuously stirring the mixture in a reflux system for 30 minutes. After 30 minutes, a quantity of ethanol equal to twice the quantity of water is added to the solution, the resulting polyvinyl alcohol concentration being preferably less than 10%. Higher concentration solutions can be used; however, they give a more viscous solution which is hard to spread evenly.

The solution is deposited on layer 118 of body 116 using a fine wire rod or knife inclined at 30–45° to the direction of movement of the knife or body. The solvent is evaporated either by drying at room temperature or by blowing hot air on the layer.

One or more coating passes are employed to give the required thickness.

Too thin a layer will result in some transfer of material from body 116, which has been correlated with "clumping" or agglomeration of the toner particles in the liquid toner. This is believed to be caused by photoreceptor deterioration. While four micrometers of material appears to be sufficient to avoid leaching, a somewhat larger thickness, for example, 6 micrometers, is preferably used.

Other barrier materials and other thicknesses may be used depending on the carrier liquid used for the toner or the gasses released by body 116. Other materials may require lesser or greater toner thickness depending on their resistance to the carrier liquid or the gasses released by body 116. Alternatively, if body 116 is resistant to leaching by the carrier liquid or does not contain materials which are released (especially when body 116 is heated), layer 115 may be omitted.

Polyvinyl alcohol is a thermoplastic crystalline material having a melting point which is higher than the temperature of the blanket during operation. Polyvinyl alcohol is also believed to form a layer which is impervious to gasses and to the hydrocarbon carrier liquid used in the liquid toner.

Conductive layer 114 is preferably formed of acrylic rubber loaded with conductive carbon black. In a preferred embodiment of the invention, only 2–3 micrometers of conductive coating are required. The conductive layer is formed by first compounding 300 grams of Hytemp 4051EP (B. F. Goodrich) with 6 grams of Hytemp NPC 50 and 9 grams of sodium stearate in a two-roll mill for 20 minutes; and then dissolving 150 grams of the compounded material in 2000 grams of methyl ethyl ketone (MEK) by stirring for 12 hours at room temperature.

40 grams of conductive carbon black, such as, for example, Printex XE2 (Degussa) are added to the solution and the mixture is ground in a 01 attritor (Union Process) loaded with 3/16" steel balls. Grinding proceeds at 10° C. for 4 hours after which time the material is diluted by the addition of MEK to a concentration of 7.5–8% solids and discharged from the grinder in the form of a conductive lacquer.

The blanket (after step 3 or step 4) is overcoated with about 3 micrometers of the conductive lacquer (three passes using a No. 0 rod) and allowed to dry for 5 minutes at room temperature.

An additional coating of primer is added over the conductive lacquer (except for the portion which is to be inserted into bar 108) before the soft elastomeric conforming layer is applied.

The resistance of the conductive layer should preferably be more than about 20 kohms/square and preferably less than about 50 kohm/square. This value will depend on the resistivity of the layers above the conducting layer and on the aspect ratio of the blanket. In general, the resistance should be low enough so that the current flowing on the conducting layer (to supply leakage current through the overlying layers) should not cause a substantial variation of voltage along the surface of the blanket. The resistance of the conducting layer and, more importantly, the resistance of the overlying layers control the current flowing through the overlying layers. Generally speaking, the conductive layer has a relatively low resistance and resistivity, the conforming layer (layer 111) has a higher resistivity and the overlying release layer (layer 109) has a still higher resistivity.

6—One kg of pre-filtered Fomrez-50 Polyester resin (Hagalil Company, Ashdod, Israel) is dehydrated and degassed under vacuum at 60° C. 600 grams of the degassed material is mixed with 1.4 grams of di-butyl-tin-diluarate (Aldrich) and degassed at room temperature for 2 hours. 30 grams of the resulting material, 3.15 grams of RTV Silicone 118 (General Electric), 4.5 grams of Polyurethane cross-linker, DESMODUR 44V20 (Bayer) and are stirred together. A 100 micrometer layer of the material is coated over the primed conductive layer using a No. 3 wire rod with several passes under clean conditions, preferably, class 100 conditions. The coating is cured for two hours at room temperature under a clean hood to form a polyurethane layer.

Layer 111 which is thus formed should have a resistance of the order of about $10^9$ ohm-cm, good thermal stability at the working temperature of the blanket, which is preferably about 100° C. or less.

The function of the conforming layer is to provide good conformation of the blanket to the image forming surface (and the image on the image forming surface) at the low pressures used in transfer of the image from the image forming surface to the blanket. The layer should have a Shore A hardness preferably of between 25 or 30 and 65, more preferably about 50. While a thickness of 100 micrometers is preferred, other thicknesses, between 50 micrometers and 300 micrometers can be used, with 75 to 125 micrometers being preferred.

7—12 grams of RTV silicone 236 (Dow Corning) release material diluted with 2 grams of Isopar L (Exxon) and 0.72 grams of Syl-off 297 (Dow Corning) are mixed together. A wire rod (bar No. 1) coating system is used, with five or six passes, under clean conditions to achieve an 8 micrometer release layer thickness. The material is cured at 140° C. for two hours. The cured release material has a resistivity of approximately $10^{14}$ to $10^{15}$ ohm-cm.

In order to mount blanket 100 on drum 102, mounting legs 110 are inserted into a plurality of mounting holes 130 formed in drum 102, preferably without removing the mylar sheet from the adhesive layer (the back of the blanket). As can be seen most clearly in FIGS. 3A, 3B and 4D, mounting legs 110 each have a tip portion 132 and a back portion 134. Tips 132 are inserted into slots formed in the far sidewalls of mounting holes 130 and the back portion 134 rests against the opposite sidewall of the hole. In this way the end of the blanket is accurately positioned. The edge of the mylar sheet closest to the legs is removed and the remainder of the mylar sheet is progressively removed while making sure that the successive portions of the blanket which are thus attached to the drum by the adhesive lie flat against the drum.

Figure 5:
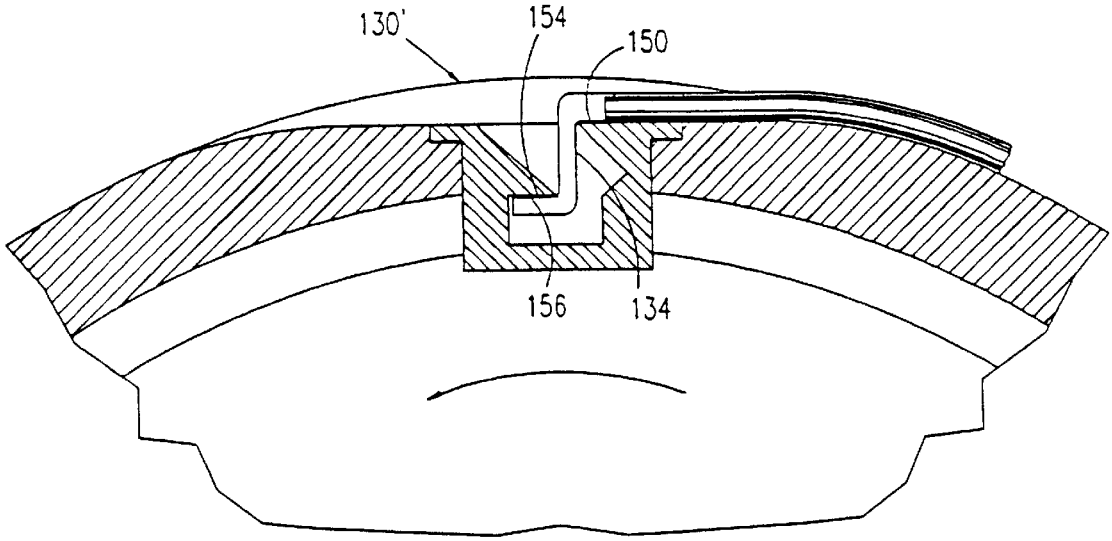
FIG. 5 is a simplified cross-sectional illustration of a portion of an intermediate transfer member, including a removable intermediate transfer blanket mounted on a drum in accordance with another preferred embodiment of the invention.

FIG. 5 shows an alternative, preferred embodiment of the invention in which somewhat different shaped holes 130' are used. In this embodiment the back portion 134 rests against a protrusion 150 formed on one side of the hole while a surface 154 of leg 110 rests against the bottom 156 of a protrusion formed on the other side of the hole.

While the preferred electrical connection between the conductive layer and the mounting bar is preferably achieved by removing (or not forming) the layers which overlay an end portion of the conductive layer and piercing the overlying layers, for example, by crimping and/or piercing the mounting bar, for example, at points marked 160 in FIG. 4D. Crimping can also be used to hold the blanket in the mounting bar.

While the adhesive layer preferably covers the back of the blanket, alternatively the adhesive layer may cover only a portion of the back such as the edge farthest away from the bracket (the trailing edge of the blanket); or may, for some embodiments of the invention and under certain circumstances, be omitted.

It should be understood that the invention is not limited to the specific type of image forming system or transfer system used. The invention is also useful in systems, such as those using other types of intermediate transfer members such as belt or continuous coated drum type transfer members and also for imaging systems which use direct transfer of the image (for example from an imaging surface) to the final substrate and which include a fuser for fusing the image to the substrate. Such systems are very well known in the art.

The specific details given above for the image forming system are included as part of a best mode of carrying out the invention. However, many aspects of the invention are applicable to a wide range of systems as known in the art for electrophotographic printing and copying.

It will be appreciated by persons skilled in the art that the present invention is not limited by the description and example provided hereinabove. Rather, the scope of this invention is defined only by the claims which follow:

We claim:

1. An image forming method comprising:

providing an image on a substrate, the image comprising toner particles including a major amount of a polymer material, an additional material which is solid at room temperature and carrier liquid;

fusing the image to the substrate by heating the image to a fusing temperature at which the toner particles soften to a first viscosity; and cooling the image after fusing, wherein the additional material has a second viscosity at the fusing temperature which is at least ten times lower than the first viscosity.

2. A method according to claim 1 wherein the toner particles are solvated by the carrier liquid at the fusing temperature whereby their viscosity is reduced to the first viscosity.

3. A method according to claim 1 wherein the additional material is solvated by the carrier liquid at the fusing temperature whereby its viscosity is reduced to the second viscosity.

4. A method according to claim 1 wherein, during fusing or subsequent cooling, at least a portion of the additional material migrates to the surface of the image away from the substrate.

5. A method according to claim 4 wherein, during cooling, at least a portion of the additional material forms a separate phase from the toner material at said surface.

6. A method according to claim 1 wherein, after cooling, the additional material forms an abrasion resistant layer covering the toner material.

7. A method according to claim 1 wherein the first viscosity is at least 100 times the second viscosity.

8. A method according to claim 1 wherein the first viscosity is at least 100 times the second viscosity.

9. A method according to claim 1 wherein the additional material comprises a polyethylene.

10. A method according to claim 1 wherein the additional material comprises a polyethylene wax.

11. A method according to claim 1 wherein the additional material comprises a homopolymer.

12. A method according to claim 1 wherein the additional material comprises a low molecular weight ionomer.

13. A method according to claim 9 wherein the additional material further comprises zinc stearate.

14. A method according to claim 1 wherein the additional material is comprised in the toner particles.

15. A method according to claim 1 wherein the additional material is in a finely divided form and is dispersed in the carrier liquid separate from the toner particles.

16. A method according to claim 1 wherein the polymer material comprises an ethylene terpolymer.

17. A method according to claim 1 wherein the polymer material comprises an ionomer.

18. A method according to claim 1 wherein the polymer material comprises an ethylene copolymer.

19. A method according to claim 1 wherein the additional material is at least partially incompatible with the toner particles.

20. A liquid toner adapted for fusing at a fusing temperature comprising:

toner particles comprising a polymer material which has a first viscosity at the fusing temperature;

an additional material which is solid at room temperature and has a second viscosity at the fusing in temperature; and carrier liquid, the first viscosity being at least ten times the second viscosity.

21. A liquid toner according to claim 20 wherein the polymer material is solvated by the carriers liquid at the fusing temperature whereby its viscosity is reduced to the first viscosity.

22. A liquid toner according to claim 20 wherein the additional material is solvated by the carrier liquid at the fusing temperature whereby its viscosity is reduced to the second viscosity.

23. A liquid toner according to claim 20 wherein the first viscosity is at at 100 times the second viscosity.

24. A liquid toner according to claim 23 wherein the first viscosity is at least three orders of magnitude greater than the second viscosity.

25. A liquid toner according to claim 20 wherein additional material comprises a polyethylene.

26. A liquid toner according claim 25 wherein the additional material comprises a polyethylene wax.

27. A liquid toner according to claim 20 wherein the additional material comprises a homopolymer.

28. A liquid toner according to claim 20 wherein the additional material comprises a low molecular weight ionomer.

29. A liquid toner according to claim 25 wherein the additional material further comprises zinc stearate.

30. A liquid toner according to claim 20 wherein the additional material is comprised in the toner particles.

31. A liquid toner according to claim 20 wherein the additional material is in a finely divided form and is dispersed in the carrier liquid separate from the toner particles.

32. A liquid toner according to claim 20 wherein the polymer material comprises an ethylene terpolymer.

33. A liquid toner according to claim 20 wherein the polymer material comprises an ionomers.

34. A liquid toner according to claim 20 wherein the polymer material comprises an ethylene copolymer.

35. A method according to claim 20 wherein the additional material is at least partially incompatible with the toner particles.

* * * * *

UNITED STATES PATENT AND TRADEMARK OFFICE

CERTIFICATE OF CORRECTION

PATENT NO. : 5,923,929

DATED : July 13, 1999

INVENTOR(S) : P. AVRAHAM et al.

It is certified that error appears in the above-identified patent and that said Letters Patent is hereby corrected as shown below:

At column 13, line 2 (claim 8, line 2) of the printed patent, "100" should be ---1000---.

At column 13, line 37 (claim 21, line 2) of the printed patent, "carriers" should be ---carrier---.

At column 14, line 6 (claim 23, line 2) of the printed patent, "at" (second occurrence) should be ---least---.

At column 14, line 11 (claim 25, line 1) of the printed patent, after "wherein" insert ---the---.

On the cover of the printed patent, at item [56], References Cited, Other Publications, line 12, after "June 18," insert ---1993---.

Signed and Sealed this

Eighteenth Day of July, 2000

*Attest:*

Q. TODD DICKINSON

*Attesting Officer*

*Director of Patents and Trademarks*